United States Patent [19]

Naito et al.

[11] 4,412,772

[45] Nov. 1, 1983

[54] SHIFTABLE ARTICLE STORAGE DEVICE

[75] Inventors: Han-Ichiro Naito, Akishima; Tsuneo Yamaguchi, Tokyo; Kiyoshi Harashima, Ome, all of Japan

[73] Assignee: Elecompack Company, Ltd., Tokyo, Japan

[21] Appl. No.: 234,949

[22] Filed: Feb. 17, 1981

Related U.S. Application Data

[62] Division of Ser. No. 124,726, Mar. 16, 1971.

[30] Foreign Application Priority Data

| | | | |
|---|---|---|---|
| Mar. 17, 1970 | [JP] | Japan | 45-22501 |
| Jun. 29, 1970 | [JP] | Japan | 45-56748 |
| Jul. 14, 1970 | [JP] | Japan | 45-61662 |
| Dec. 28, 1970 | [JP] | Japan | 45-125408 |

[51] Int. Cl.[3] ..... A47B 53/00; A47F 3/08; B65G 1/00

[52] U.S. Cl. ..... 414/331; 104/1 R; 211/1.5; 312/198; 312/199; 312/201; 414/787

[58] Field of Search ..... 414/331, 787; 312/198, 312/199, 200, 201; 211/1.5; 104/287, 288, 1 R

[56] References Cited

U.S. PATENT DOCUMENTS

| | | | |
|---|---|---|---|
| 3,168,361 | 2/1965 | Naito | 312/199 |
| 3,186,355 | 6/1965 | Stoll et al. | 414/331 |
| 3,566,802 | 3/1971 | Lundqvist | 312/199 |
| 3,575,298 | 4/1971 | Ruoss | 104/1 R |
| 3,615,122 | 10/1971 | Naito et al. | 312/199 |
| 3,640,595 | 2/1972 | Staller et al. | 312/200 |
| 3,957,323 | 5/1976 | Tucker et al. | 312/198 |
| 4,017,131 | 4/1977 | Camenisch | 312/201 |

FOREIGN PATENT DOCUMENTS

| | | | |
|---|---|---|---|
| 1568971 | 4/1969 | France | 312/201 |

*Primary Examiner*—Charles E. Frankfort
*Attorney, Agent, or Firm*—Richard L. Cannaday; William J. Ungvarsky; Francis C. Hand

[57] ABSTRACT

A shiftable article storage device having a plurality of shiftable article storage units each adapted for mounting articles to be stored thereon and provided with a driving source. The article storage units are put together with no interval between each other when not in use but shifted, when an article on one of them is desired to be taken out, in such a manner that an aisle is formed on one side of one article storage unit to provide access to the article.

13 Claims, 23 Drawing Figures

RELAY
RELAY
RELAY

SHIFTABLE ARTICLE STORAGE DEVICE

This is a division, of application Ser. No. 124,726 filed Mar. 16, 1971.

This invention relates to shiftable article storage devices comprising a plurality of shiftable article storage units for mounting articles to be stored thereon, said article storage units being put together with no interval between each other when not in use but shifted, when an article on one of them is desired to be taken out, in such a manner that an aisle is formed on one side of said article storage unit to provide access to said article.

In order that a large number of article storage units may be accommodated in a narrow space, there has been proposed a shiftable article storage device having a plurality of shiftable article storage units closely arranged over the entire area of a given space except for an area just enough to form an aisle, said shiftable article storage units being shifted when access is desired to be had to one of them, in such a mannr that an aisle is formed between said particular article storage unit and the adjacent unit.

In the conventional shiftable article storage device of the type described, only one motor is provided as a driving source and the shiftable article storage units are shifted by power transmitting members, such as chains or feeders, driven by said motor. Therefore, the load imposed on the motor varies according to the number of the article storage units to be shifted, which requires the output of the motor to be large. In addition, when the articles stored on the shiftable article storage units are large in size and/or heavy in weight, the shifting of a plurality of the article storage units by a single motor results in overloading of the motor and calls for a large-sized and complicated driving mechanism since the strengths of the power transmitting members must be increased.

Further, in most of the conventional shiftable article storage devices, only a space just enough to form an aisle is usually available for the entire device as stated above or for each of a plurality of groups into which the article storage units of the device are segregated. Therefore, when the location of the aisle is desired to be shifted from one place to another, it is necessary to return the device to the original state upon completion of the work through the aisle formed at said one place and then operate the device to form an aisle at said another location, and such cumbersome operation must be performed at each occurrence of storage work. This has been the most serious shortcoming of the conventional devices.

The present invention relates to improvements in the shiftable article storage devices of the type described. Namely, an object of the present invention is to provide a shiftable article storage device wherein each of a plurality of article storage units is provided with a driving motor, whereby the article storage units can be individually shifted without being influenced by the size and weight of the articles stored thereon, and the storage work can be achieved by a simple operation with high efficiency.

Another object of the invention is to provide a shiftable article storage device wherein a space sufficient to form a plurality of aisles is previously provided, whereby a plurality of aisle can be formed simultaneously at different locations between the article storage units.

Still another object of the invention is to provide a shiftable article storage device which is so designed that, once an aisle instruction is given, an aisle is formed at a designated location and the article storage units on both sides of the aisle are automatically locked and held immovable, even if the formation of the aisle at the other location is instructed, unless a return operation is performed.

Still another object of the invention is to provide a shiftable article storage device which is so designed that one or a plurality of optional article storage units are temporarily locked by operating a switch, whereby the entire article storage units are segregated into a plurality of groups, and an aisle can be formed within each of said groups independently of the other groups.

A further object of the invention is to provide a shiftable article storage device wherein each adjacent article storage units are shiftably connected with each other by aisle width control means by which the width of the aisle to be formed between the adjacent units upon shifting of the same is automatically controlled.

Other objects, features and advantages of the invention will become apparent from the following detailed description taken in conjunction with the accompanying drawings, in which.

FIGS. 1 to 22 show one embodiment of the present invention in which the article storage units are shiftable stack units. In this embodiment, the shiftable stack units are each provided on the confronting faces thereof with a limit switch as means for detecting the engagement and disengagement of the adjacent shiftable stack units, said limit switch being held in an ON-position when the adjacent stack units are spaced from each other and held in an OFF-position when they are in contact with each other. Further, in this embodiment aisle width control means is provided to control the width of the aisle to be formed and an arrangement is made so that two aisles may be formed concurrently.

Figure 1:
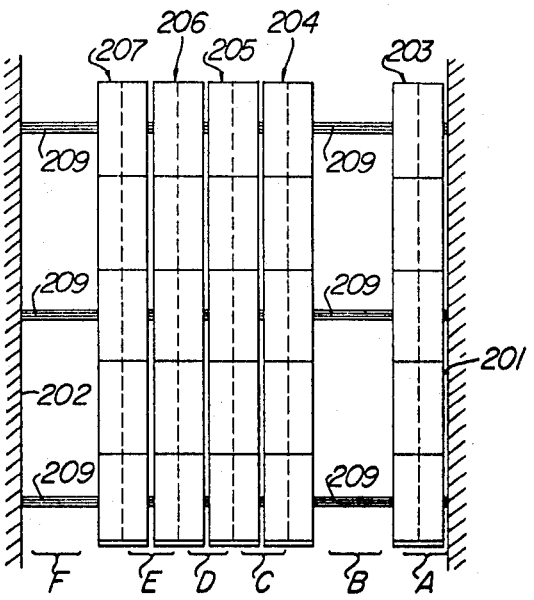
FIG. 1 is a plan view of an embodiment of the invention in which shiftable stack units each having a plurality of shelves are used as article storage units.
Figure 2:
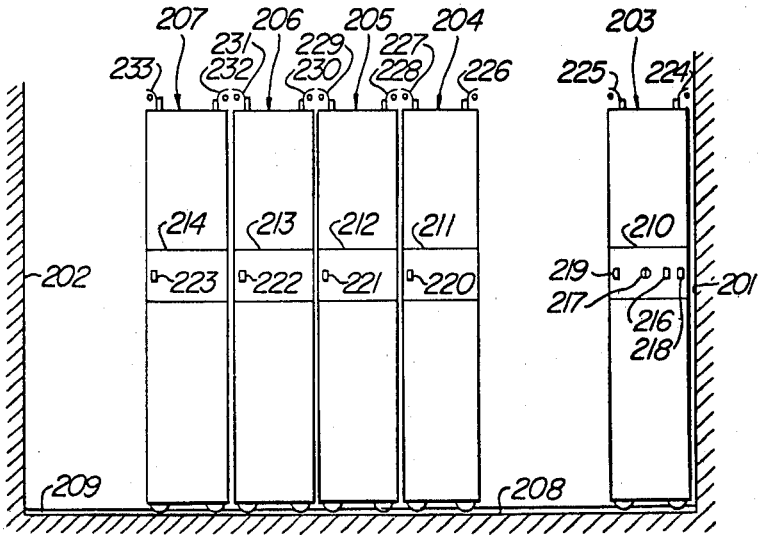
FIG. 2 is a front view of the shiftable stack unit.

As shown in FIGS. 1 and 2, five shiftable stack units 203, 204, 205, 206 and 207 are arranged between the side walls 201 and 202 of a warehouse of the like in such a manner that they are horizontally movable on three guide rails 209 provided in the floor 208 of the warehouse or the like. Reference characters A . . . F indicate aisles to be formed upon shifting of the shiftable stack units, and the aisles B and F are formed in the illustration of FIG. 1. In this embodiment, as will be apparent from FIGS. 1 and 2, reference numerals of the shiftable stack units and reference characters of the aisle are given from the right to left.

As shown in FIG. 2, on the side wall of the shiftable stack unit 203 is provided a control board 210 which has a power source switch 216 and a special operation switch 217 at the center, an aisle switch 218 for the aisle A on the right side an an aisle switch 219 for the aisle B on the left side thereof. Each of control boards 211 . . . 214 provided on the shiftable stack units 204 . . . 207 has aisle switches 218 . . . 223 provided on the left side thereof respectively. The power source switch 216 has one lamp and the aisle switches 218 . . . 223 each have two lamps therein respectively (though not shown in FIG. 2). These switches are of the seesaw type or snap type. Further, the shiftable stack units 203 . . . 207 are respectively provided with aisle illuminating lamps 224 . . . 233 on the top walls thereof. Namely, the shiftable stack unit 203 has the illuminating lamp 224 on the right side of the top wall for illuminating the aisle A and the illuminating lamp 225 on the left side thereof for illuminating the aisle B, and the shiftable stack unit 204 has the illuminating lamp 226 for illuminating the aisle B and the illuminating lamp 227 for illuminating the aisle C, and so on. The arrangement is made such that, when an aisle is formed, the illuminating lamps on the shiftable stack units on the opposite sides of said aisles are lit. It is possible to arrange such that lamps provided on the side walls 201 and 202 (though not shown in FIG. 2) may be lit when the aisles A and F are formed.

Figure 3:
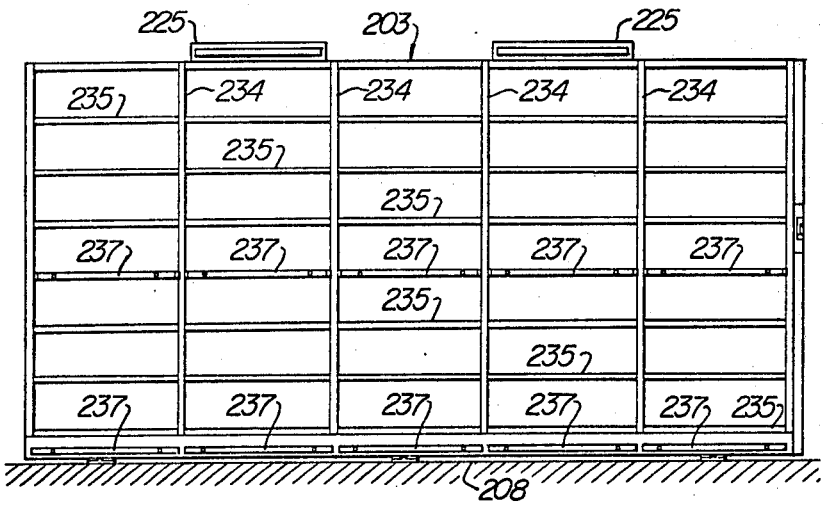
FIG. 3 is a side view showing the details of the shitable stack unit.

Each shiftable stack unit has two storage sections separated in the shifting direction at the center thereof as indicated by the dotted line in FIG. 1 and each storage section is divided into five lateral subsections and seven vertical sub-sections by posts 234 and shelf boards 235 respectively as shown in FIG. 3. The fourth shelf board 235 and a truck 236 are each provided with spring-biased safety bars 237.

Figure 4:
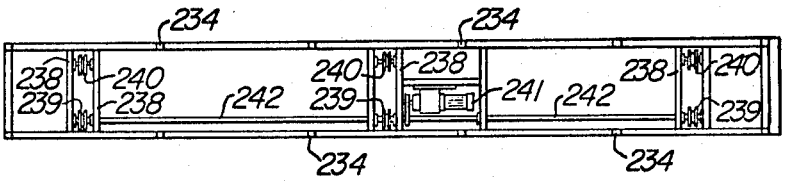
FIG. 4 is a plan view showing the truck of the shiftable stack unit.

The truck 236 is reinforced by a plurality of transverse girders 238 as shown in FIG. 4 and has driving wheels 239 and follower wheels 240 rotatably mounted thereon for rolling on the guide rails 209. The driving wheels 239 are fixedly mounted on a driving shaft 242 which is driven by a motor 241 mounted on the truck 236.

Figure 5:
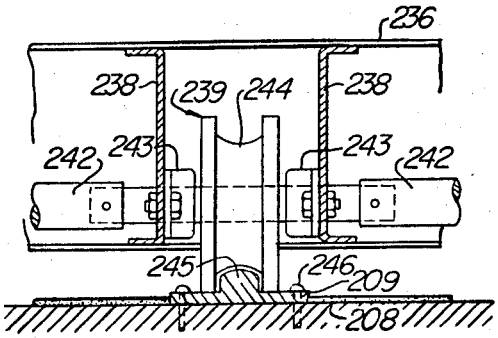
FIG. 5 is a view showing the wheel mounted on the truck frame and a guide rail.

FIG. 5 shows the relative position of the driving wheel 239 of the truck 236 and the guide rail 209 shown in FIG. 4. As shown, the driving wheel 239 is rotatably supported by bearings 243 between the transverse girders 238 and has an annular recess 244 along the center of the peripheral surface thereof, in which a central projection 245 of the guide rail 209 is received. The guide rail 209 is secured to the floor 208 by anchor bolts 246. The follower wheel 240 is also rotatably supported on the transverse girders by means of bearings in the same manner as the driving wheel 239 though not shown in the Figure.

FIGS. 6 to 9 shows the details of the limit switch for stopping the stack unit when said stack unit is brought into engagement with the adjacent stack unit, and the aisle width control means for stopping the stack unit when the isle being formed has reached a predetermined width. With reference first to the limit switch the shiftable stack unit 203 is provided at the lower portion of the side facing the aisle A with a limit switch 252 which is adapted to be placed in an OFF-position when engaged by a projection 247 provided on the side wall 201 and placed in an ON-position when disengaged from said projection, and at the lower portion of its side facing the aisle B with a limit switch 253, similar to the limit switch 252, for engagement with a projection 249 on the shiftable stack unit 204, and a projection 248 for engagement with a limit switch 254 provided on the shiftable stack unit 204. The shiftable stack unit 204 is provided at the lower portion of its side facing the aisle C with a limit switch 255 for engagement with a projection 205 on the shiftable stack unit 205 and a projection 250 for engagement with the limit switch 256 on the shiftable stack unit 205. Similarly, the shiftable stack units 205, 206 and 207 are respectively provided with limit switches 257, 258, 259, 260 and 261 and projections for engagement with said respective limit switches (though not shown in FIGS. 6 and 8). The limit switches 253–260 thus serve as a detecting means for detecting whether adjacent ones of the article storage units (stack units) 203–207 are in contact with each other or not.

Figure 6:
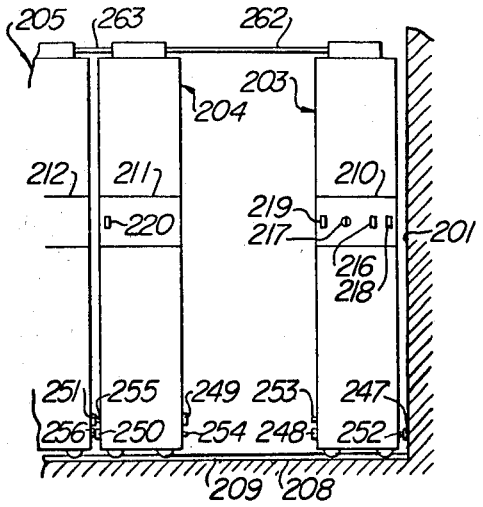
FIG. 6 is a front view showing limit switches provided at the lower portion and aisle width control means provided at the upper portion of the shiftable stack unit.
Figure 8:
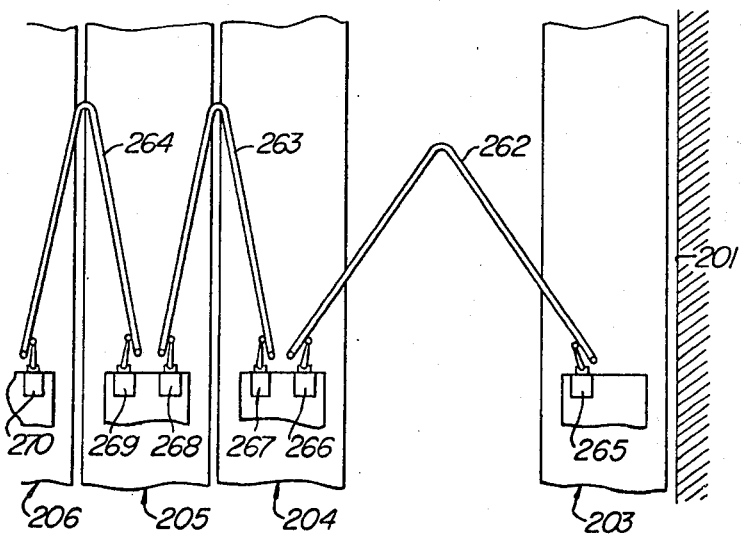
FIG. 8 is a view showing the details of the aisle width control means of the shiftable stack unit, in the state wherein the shelf units are spaced to form an aisle.
Figure 9:
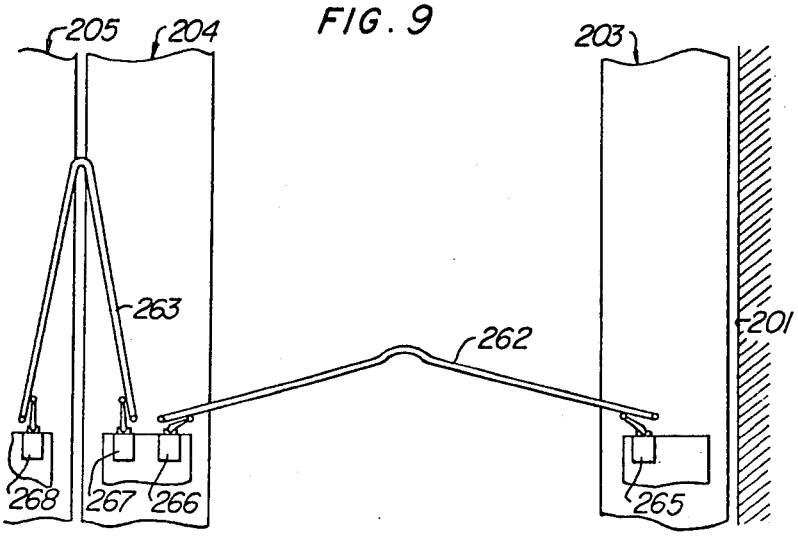
FIG. 9 is a view showing the state wherein the function of the aisle width control means is released and the shelf units are fully opened.

The aisle width control means is provided on the top wall of each shiftable stack unit as shown in FIGS. 6, 8 and 9. With reference to the aisle B, an arm 262 flexible at the center thereof is provided across the aisle B, with the opposite ends thereof pivotally connected to the shiftable stack units 203 and 204, and aisle width control switches 265 and 266 are provided on the shiftable stack units 203 and 204 adjacent the pivoted ends of said arm 262 so as to be actuated by said arm 262. Similarly, an arm 263 is provided extending between the shiftable stack units 204 and 205 and limit switches 267 and 268 are provided on said shiftable stack units 204 and 205 to be actuated by said arm 263 respectively. The shiftable stack units 205 and 206 have an arm 264 therebetween and are provided with limit switches 269 and 270 respectively to be actuated by said arm. In the same manner, the shiftable stack units 206 and 207 have an arm therebetween and limit switches 271 and 272 respectively, and so on, though not shown in FIGS. 6, 8 and 9. Each arm is a hollow tubular body and a conductor is extended therethrough for electrical connection between the adjacent stack units, though not shown. The limit switches each are of such a type that they are held in an ON-position when the associated stack units are in a relative position such as that of the stack units 204 and 205 or 205 and 206, and in an OFF-position when the associated stack units are in a relative position such as that of the stack units 203 and 204 in FIG. 8.

Figure 10:
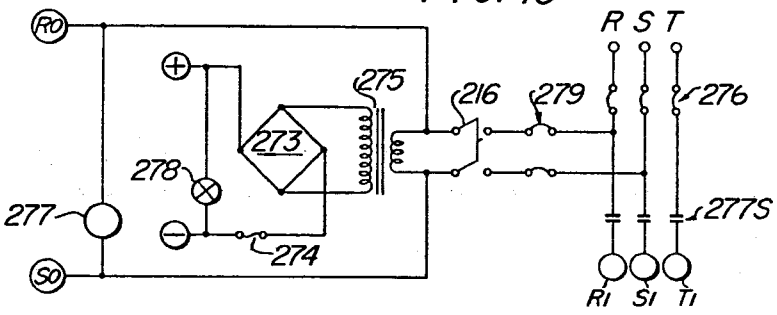
FIG. 10 is a power source circuit diagram.

FIG. 10 shows a power source circuits and a rectifier 273 connected between the (+) and (−) terminals of a power source through a fuse 274. The rectifier 273 is also connected to the secondary coil of a transformer 275, the primary coil of which is connected to the power source switch 216 of the shiftable stack unit 203. The terminals R, S and T of the three-phase power source are respectively connected to terminals R1, S1 and T1 through no-fuse breakers 276 and the make contacts 277S of electromagnetic switches 277 through which the motors on the respective shiftable stack units are connected to the power source. The electromagnetic switch 277 is connected between the terminals R0 and S0 of the primary coil of the transformer 275. A power source indicating lamp 278 is connected between the (+) and (−) terminals and accommodated in the power source switch 216 on the shiftable stack unit 203 as stated previously. The power source switch 216 is connected to conductors leading from the terminals R and S, through no-fuse breakers 279.

Figure 11:
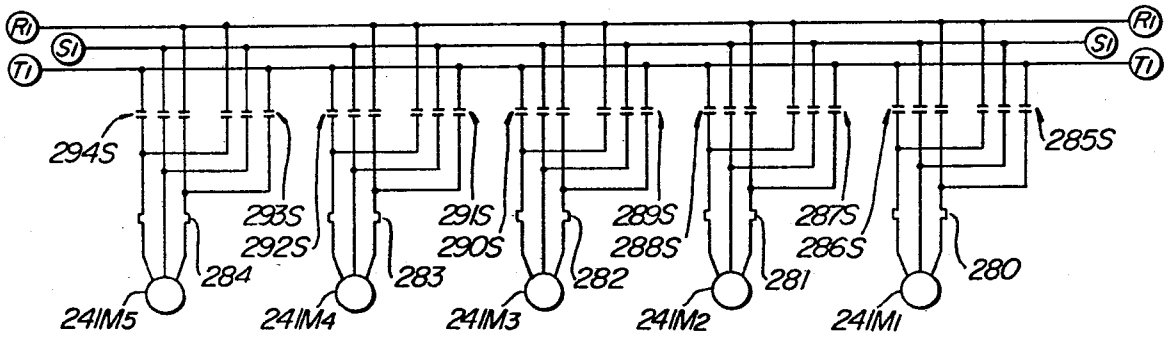
FIG. 11 is a circuit diagram of a motor to drive the shiftable stack unit.

FIG. 11 shows a motor circuit for driving each shiftable stack unit, and the motor on the shiftable stack unit 203 is indicated by reference numeral 241M1 and similarly, the motors on the other shiftable stack units are indicated by reference numerals 241M2, 241M3, 241M4 and 241M5 respectively; thermal relays for detecting overloading of the respective motors are indicated by reference numerals 280 . . . 284 respectively; and the make contacts of electromagnetic switches for rightward and leftward shifting are indicated by reference numerals 285S . . . 294S respectively.

Figure 12:
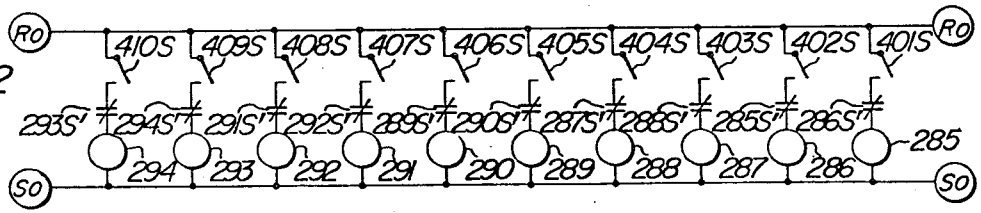
FIG. 12 is a circuit diagram of an electromagnetic switch for the motor.

FIG. 12 shows a circuit to operate the electromagnetic switches 285 . . . 294 for the motors. The electromagnetic switch 285 of the motor 241M1 for rightward shifting is connected between the terminals R0 and S0 through the make contact 401S of an electromagnetic switch auxiliary relay 401 for rightward shifting and the break contact 286S' of the electromagnetic switch 286 for leftward shifting. The electromagnetic switch 286 of the motor 241M1 for leftward shifting is connected between the terminals R0 and S0 through the make contact 402S of an electromagnetic switch auxiliary relay 402 for leftward shifting and the break contact 285S' of the electromagnetic switch 285 for rightward shifting, in parallel relation to said electromagnetic switch 285. The electromagnetic switches 287 . . . 294 of the motors 241M2 . . . 241M5 for rightward and leftward shifting, similar to that of motor 241M1, are connected between the terminals RO and SO through the make contacts 403S . . . 410S of electromagnetic switch auxiliary relays 403 . . . 410 and electromagnetic switches 288S', 287S' . . . 294S' and 293S' for reverse shifting respectively, in parallel relation to the electromagnetic switch 285.

Figure 13:
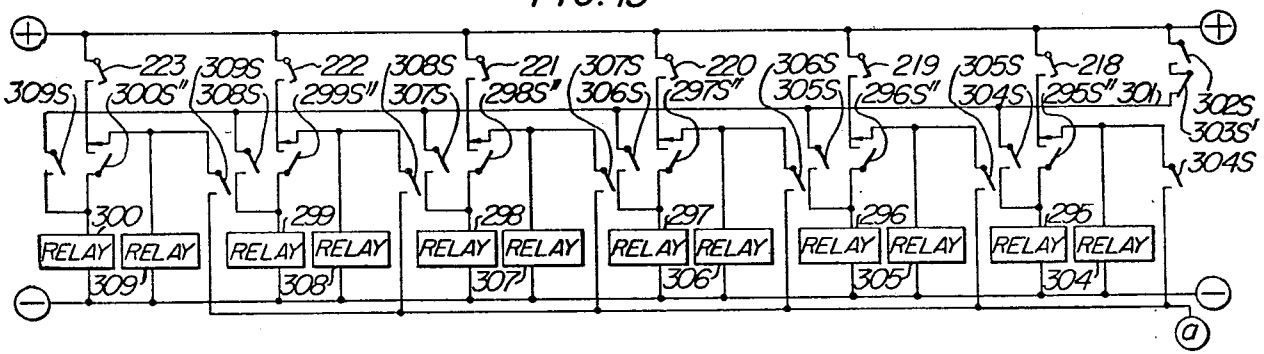
FIG. 13 is a circuit diagram of an aisle selecting circuit to select an aisle to be formed.
Figure 19:
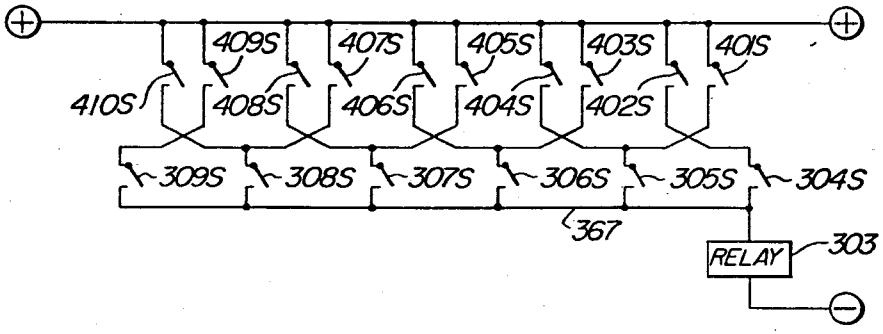
FIG. 19 is a circuit diagram of a shifting detecting circuit for detecting the shiftable stack unit being shifted.

FIG. 13 shows an aisle selecting circuit for the shiftable stack units, in which the aisle switches 218 . . . 223 provided on the respective control boards 210 . . . 214 shown in FIG. 2 are connected between the (+) and (−) terminals through aisle locking relays 295 . . . 300 and make contacts of make-before-break contacts 295S" . . . 300S" respectively. These aisle locking relays 295 . . . 300 are each adapted to break the electromagnetic switches of the motors on the adjacent shiftable stack units at the point when the aisle has been completely formed between said stack units, and restore the aisle selecting circuit. Namely, by these relays, the shiftable stack units on both sides of the formed aisle are locked, to provide for the selection of another aisle. To a conductor 301 which is connected between the (+) terminal and the aisle switch 218 through the make contact 302S of a locking delay relay 302 shown in FIG. 14 and the break contact 303S' of a shift detecting relay 303 shown in FIG. 19, are connected the make contacts 304S . . . 309S of aisle selection signal receiving relays 304 . . . 309 in parallel relation. The other ends of these make contacts 304S . . . 309S are respectively connected between the aisle locking relays 295 . . . 300 and the make-before-break contacts 295S" . . . 300S" thereof. The aisle selection signal receiving relays 304 . . . 309 for receiving a signal indicative of the selection of aisle are respectively connected in parallel between the break contact sides of the make-before-break contacts 295S" . . . 300S" and the (−) terminal, and another make contacts of said aisle selection signal receiving relays 304 . . . 309 are respectively connected between the break contact sides of the make-before-break contacts 295S" . . . 300S" and a terminal (a) in parallel relation.

Figure 14:
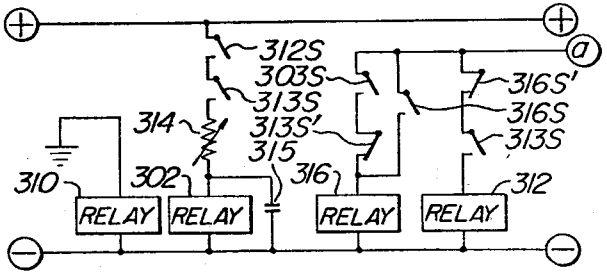
FIG. 14 is a safety means operating circuit diagram.

FIG. 14 shows a circuit to further ensure the safety of the shiftable stack units. Reference numeral 310 designates a ground relay which is actuated when the plus side of the control circuit is grounded to the stack body, to sound a warning buzzer 311 in FIG. 17, and its minus side is connected to the (−) terminal. The locking delay relay 302 by which the aisle locking relays 295 . . . 300 are held against actuation before the shiftable stack units begin to shift upon selection of the aisle, is connected between the (+) and (−) terminals through the make contact 312S of a start instructing relay 312, the make contact 313S of a safety bar operation detecting relay 313 in FIG. 16 and a variable resistor 314 which sets the delay time of the looking delay relay 302, and a capacitor 315 is connected between the junction of the variable resistor 314 and the relay 302, and the (−) terminal, by which the time limit of said relay is set. The start instructing relay 312 serves to start the selection of shiftable stack units upon verifying the normal condition of the safety device and is connected between the (a) and (−) terminals through the break contact 316S' of a safety device operation memorizing relay 316 and the make contact 313S of the safety device operation detecting relay 313. The safety device operation memorizing relay 316 memorizes the fact that the safety device is operated shifting of the shiftable stack units and is connected between the (a) and (−) terminals through the make contact 303S of the shift detecting relay 303 and the break contact 313S' of the safety bar operation detecting relay 313. The make contact 316S of the safety device operation memorizing relay 316 is connected in parallel to the make contact 303S and the break contact 313S'.

Figure 15:
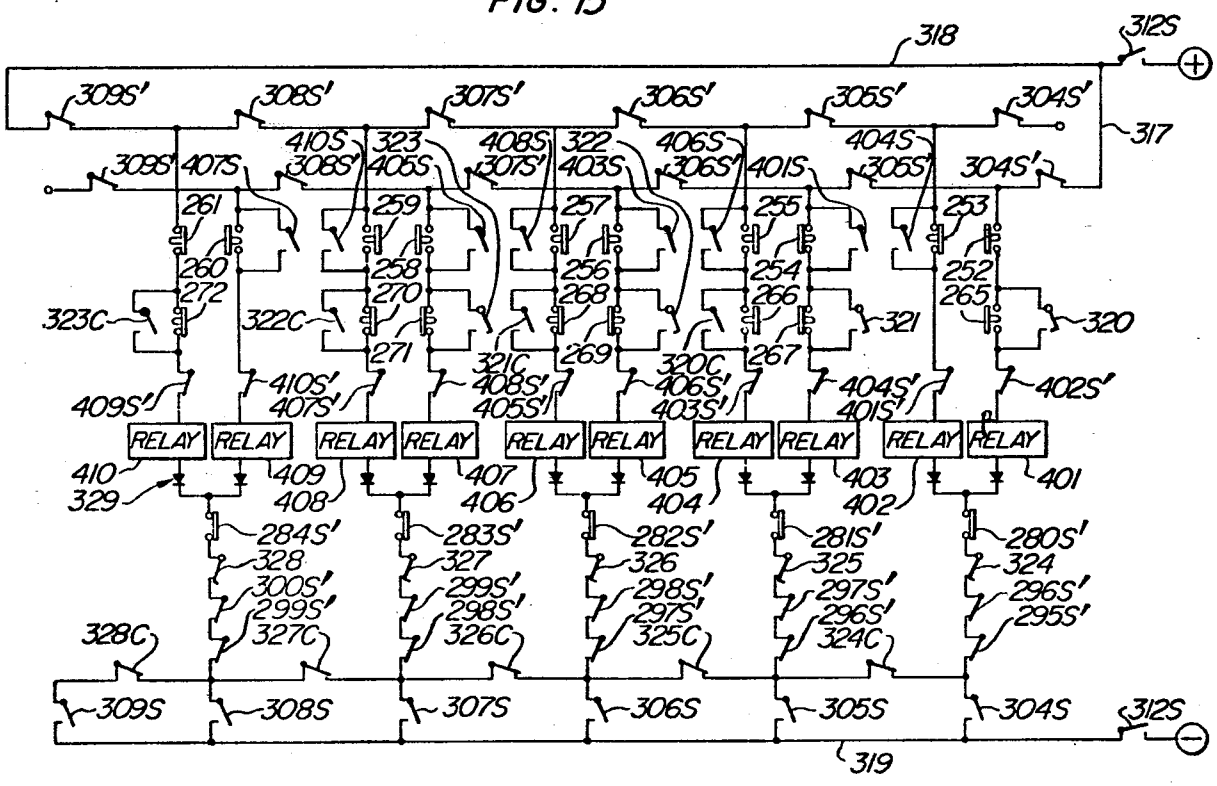
FIG. 15 is a shiftable stack unit selecting circuit diagram.

FIG. 15 shows a shiftable stack unit selecting circuit and a conductor 317 branched from the (+) terminal through the make contact 312S of the start instructing relay 312 has the break contacts 304S' . . . 309S' of the aisle selection signal receiving relays 304 . . . 309 connected in series thereto. Another branched conductor 318 similarly has the break contacts 309S' . . . 304S' connected in series thereto. Between a point of the conductor 317 intermediary of the break contacts 304S' and 305S', and a conductor 319 connected to the (−) terminal through the make contact 312S of the start instructing relay 312, is connected the electromagnetic switch auxiliary relay 401 for the motor for rightward shifting of the shiftable stack unit 203 through the limit switch 252, a parallel circuit of the aisle width control switch 265 and a switch 320 to short-circuiting said switch 265, and the break contact 402S' of the electromagnetic switch auxiliary relay 402 for leftward shifting, and through reverse-current preventing diode 329, the break contact 280S' of the thermal relay 280, a toggle switch 324 for bringing the shiftable stack unit 203 into a stationary state, the break contact 296S' of the aisle locking relay 296, the break contact 295S' of the aisle locking relay 295 and the make contact 304S of the aisle selection signal receiving relay 304. Between the junction of the reverse-current preventing diode 329 and the break contact 280S', and a point of the conductor 318 intermediary of the break contacts 305S' and 304S', is connected the electromagnetic switch auxiliary relay 402 for the motor for leftward shifting of the shiftable stack unit 203 through a parallel circuit of the limit switch 253 and the make contact 404 of the electromagnetic switch auxiliary relay 404, the break contact 401S' of the electromagnetic switch auxiliary relay 401 and the reverse-current preventing diode 329. An electromagnetic switch auxiliary relay 403 for the motor for rightward shifting of the shiftable stack unit 204 is connected between a point of the conductor 317 intermediary of the break contacts 305S' and 306S', and the conductor 319 through a parallel circuit of the limit switch 254 and the make contact 401S of the electromagnetic switch auxiliary relay 401, a parallel circuit of the aisle width control switch 267 and a switch 321 for short-circuiting said switch 267, and the break contact 404S' of an electromagnetic switch auxiliary relay 404 for leftward shifting, and further through the diode 329, the break contact 281S' of the thermal relay 281, a toggle switch 325 for bringing the shiftable stack unit 204 into a stationary state, the break contact 297S' of the aisle locking relay 297, the break contact 296S' of the aisle locking relay 296 and the make contact 305S of the aisle selection signal receiving relay 305. The electromagnetic switch auxiliary relay 404 is connected between the point of the conductor 318 intermediary of the break contacts 306S' and 305S' and the junction of the diode 329 and the break contact 281S', through a parallel circuit of the limit switch 255 and the make contact 406S, a parallel circuit of the aisle width control switch 266 and the contact 320C of the switch 320 for short-circuit said switch 266, and the break contact 403S' of the electromagnetic switch auxiliary relay 403. Electromagnetic switch auxiliary relays 405 . . . 408 for rightward and leftward shifting of the shiftable stack units 205 and 206 also respectively include short-circuit switches 322 and 323, contacts 321C and 322C operatively connected to the short-circuit switches 321 and 322 and toggle switches 326 and 327, and are connected in like manner to the electromagnetic switch auxiliary relays for rightward and leftward shifting of the shiftable stack unit 204. Electromagnetic switch auxiliary relay 409 for rightward shifting of the shiftable stack unit 207 is connected through a parallel circuit of the limit switch 260 and the make contact 407S of the electromagnetic switch auxiliary relay 407, and the break contact 410S' of an electromagnetic switch auxiliary relay 410 on one side, and through the diode 329, the break contact 284S' of the thermal relay 284, a toggle switch 328 for bringing the shiftable stack unit into a stationary state, the break contact 300S' of the aisle locking relay 300, the break contact 299S' of the aisle locking relay 299 and the make contact 308S of an aisle selection signal receiving relay 308. The electromagnetic switch auxiliary relay 410 for leftward shifting is connected between a point of the conductor 318 intermediary of the break contacts 309S' and 308S', and the junction of the diode 329 and the break contact 284S' of the thermal relay 284, through a parallel circuit of an aisle width control switch 272 and the contact 323C of a switch 323 for short-circuit said switch 272, and the break contact 409S' of the electromagnetic switch auxiliary relay 409. Further, between the junction of the break contact 295S' and the break contact 304S, and the junction of the break contact 296S' and the make contact 305S, is connected a contact 324C which is operatively connected to the toggle switch 324, and between the junction of the break contact 296S' and the make contact 305S, and the junction of the break contact 297S' and the make contact 306S, is connected a contact 325C which is operatively connected to the toggle switch 325. Similarly, contact 326C operatively connected to the toggle switch 326 is connected between the junction of the break contact 297S' and the make contact 307S, and the junction of the break contact 298S' and the make contact 307S, and a contact 327C operatively connected to the toggle switch 327 is connected between the junction of the break contact 298S' and the make contact 307S, and the junction of the break contact 299S' and the make contact 308S. Between the junction of the break contact 299S' and the make contact 308S, and the junction of the make contact 308S and the conductor 319, is connected the make contact 309S of an aisle selection signal receiving relay 309. The short-circuit switches 320 . . . 328 and the toggle switches 324 . . . 328 are provided in the control boards 210 . . . 214 of the respective shiftable stack units.

Figure 16:
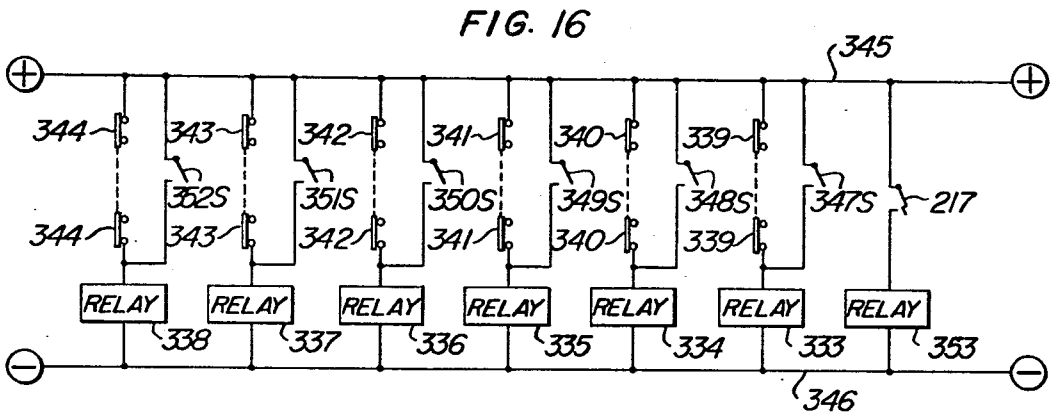
FIG. 16 is a circuit diagram of a safety bar operating circuit for the shiftable stack unit.

FIG. 16 shows an operating circuit for the safety bar provided on each shiftable stack unit. Safety bar operation signal receiving relays 333 . . . 338 which receive a signal indicative of the fact that the safety bar 237 has been pushed by an obstacle, are connected in parallel betweeen a conductor 345 connected to the (+) terminal and a conductor 346 connected to the (−) terminal, through safety bar switches 339 . . . 344 which are actuated when a plurality of the safety bars provided facting the aisle are pushed. Connected in parallel to these switches are the make contacts 347S . . . 352S of illuminating lamp lighting relays 347 . . . 352 shown in FIG. 21. Also connected between the conductors 345 and 346 are the special operation switch 217 of the shiftable stack units shown in FIG. 1 and a special operation relay 353 for receiving a signal indicative of the operation of said switch 217. This special operation switch 217 is a key switch by which the safety bar operation detecting circuit is temporarily short-circuited when the safety bar circuit fails, to enable the stack shifting operation to be performed.

Figure 17:
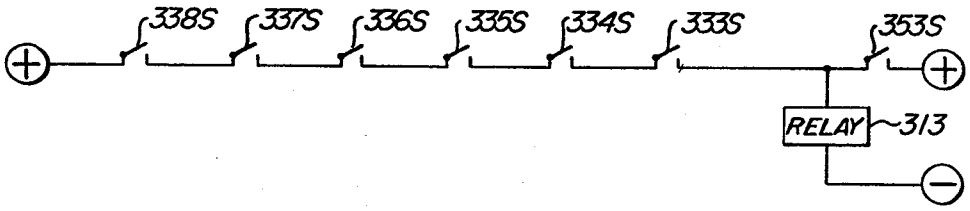
FIG. 17 is a safety bar operation detecting circuit diagram.

FIG. 17 shows a circuit for detecting the operation of the safety bars. A safety bar operation detecting relay 313 is connected between the (+) and (−) terminals through a series circuit of the make contacts 333S . . . 338S of the safety bar operation signal receiving relays 333 . . . 338, and the make contact 353S of the special operation relay 353 is connected in parallel to said circuit.

Figure 18:
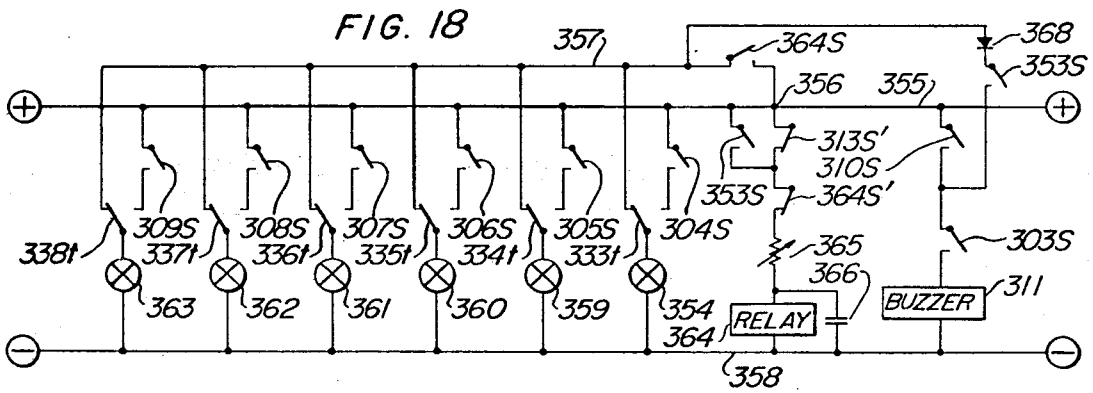
FIG. 18 is an aisle indicating lamp and warning circuit diagram.

FIG. 18 shows a circuit for lighting the aisle indicating lamps provided in the aisle switches on the control boards 210 . . . 214 of the respective shiftable stack units 203 . . . 207 and for indicating the operation of the safety device. In the aisle indicating lamp lighting circuit, the aisle indicating lamp 354 to indicate that the aisle A is open, is connected on its plus side to a conductor 355 connected to the (+) terminal, through the make contact 304 of the aisle selection signal receiving relay 304, and to a conductor 357 branched from said conductor 355 at a point 356, through the transfer contact 333*t* of the safety bar operation signal receiving relay 333, and the negative side thereof is connected to a conductor 358 connected to the (−) terminal. The aisle indicating lamps 359 . . . 363 for the aisle B to F are similarly connected on their plus side to the conductors 355 and 357 through the make contacts 305S . . . 309S of the aisle selection signal receiving relays 305 . . . 309 and transfer contacts 334*t* . . . 338*t* of the safety bar operation signal receiving relays 334 . . . 338 and on the minus side to the conductor 358, respectively. Between the conductor 357 and the branch point 356 is connected the make contact 364S of a flicker relay 364.

A warning and safety device operation indicating circuit is provided for flashing the aisle indicating lamp of a specific shiftable stack unit or sounding an alarm during when the safety bar is actuated or during the special operation. The flicker relay 364 is a relay to flicker the indicating lamp and the warning buzzer when the safety bar is in an actuated position and when the special operation is performed, and is connected between the branch point 356 and the conductor 358 with the break contact 313S' of the safety bar operation detecting relay 313, the break contact 304S' of the flicker relay 364 and the variable resistor 305 interposed between it and said branch point 356, said variable resistor 365 adjusting the rate of flicker. The make contact of the special operation relay 353 is connected in parallel to the break contact 313S' of the safety bar operation detecting relay 313, and a capable 366 is connected in parallel to the flicker relay 364 to provide intermittent flicker. A warning buzzer 311 to sound an alarm at the time of special operation or grounding is connected between the conductors 357 and 358 through a reverse-current preventing diode 368, the make contact 353S of the special operation relay 353 and the make contact 303S of the shift detecting relay 303. Between the junction of the make contacts 353S and 303S of this buzzer circuit and the conductor 355 is connected the make contact 310S of the grounding relay 310.

FIG. 19 is a circuit to detect the shifting of the shiftable stack units. Between the (+) terminal and a conductor 367 connected to the (−) terminal through the shift detecting relay 303 is connected the make contact 304S of the aisle selection signal receiving relay 304 through the make contact 402S of the electromagnetic switch auxiliary relay 402 for the motor for leftward shifting of the shiftable stack unit 203. The make contact 305S of the aisle selection signal receiving relay 305 is connected between the (+) terminal and the conductor 367 through a parallel circuit of the make contact 401S of the electromagnetic switch auxiliary relay 401 for rightward shifting of the shiftable stack unit 203 and the make contact 404S of the electromagnetic switch auxiliary relay 404 for leftward shifting of the shiftable stack unit 204, and the make contact 306S of the aisle selection signal receiving relay 306 is connected between the (+) terminal and the conductor 367 through a parallel circuit of the make contact 403S of the electromagnetic switch auxiliary relay 403 for rightward shifting of the shiftable stack unit 204 and the make contact 406S of the electromagnetic switch auxiliary relay 406 for leftward shifting of the shiftable stack unit 205. Similarly, the make contacts 307S and 308S of the aisle selection signal receiving relays 307 and 308 are connected in parallel between the (+) terminal and the conductor 367 through a parallel circuit of the make contacts 405S and 408S and a parallel circuit of the make contacts 407S and 410S respectively, and the make contact 309S of the aisle selection signal receiving relay 309 through the make contact 409S.

Figure 20:
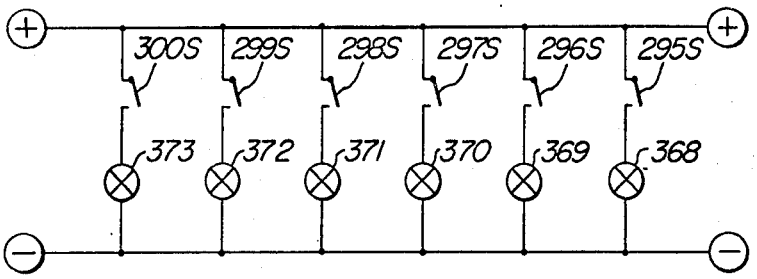
FIG. 20 is a circuit diagram of aisle locking indicating lamps to indicate the formation of an aisle.

FIG. 20 is an indicating lamp circuit to indicate the locking of a specific aisle, which includes aisle locking indicating lamps 368 . . . 373 by which it is indicated at the point when the selected aisle has been formed and shifting of the shiftable stack units has been completed, the fact that the shiftable stack units on both sides of the aisle are locked and the control circuit is restored. These lamps are connected between te (+) and (−) terminals through the make contacts 295S . . . 300S of the aisle locking relays 295 . . . 300 respectively.

Figure 21:
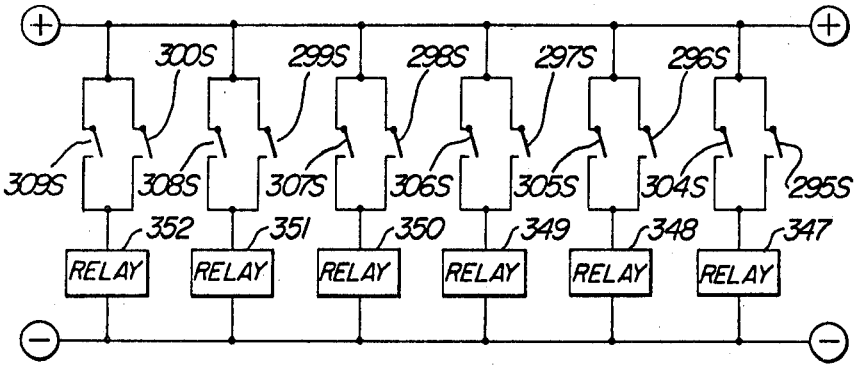
FIG. 21 is a circuit diagram of a circuit for operating an illumination lamp provided on the top of each shiftable stack unit.

FIG. 21 shows an illuminating lamp lighting relay. The illuminating lamp lighting relays 347 . . . 353 to light the illuminating lamps are connected between the (+) and (−) terminals through parallel circuits of the make contacts 295S . . . 300S of the aisle locking relays 295 . . . 300 and the make contacts 304S . . . 309S of the aisle selection signal receiving relays 304 . . . 309, respectively.

Figure 22:
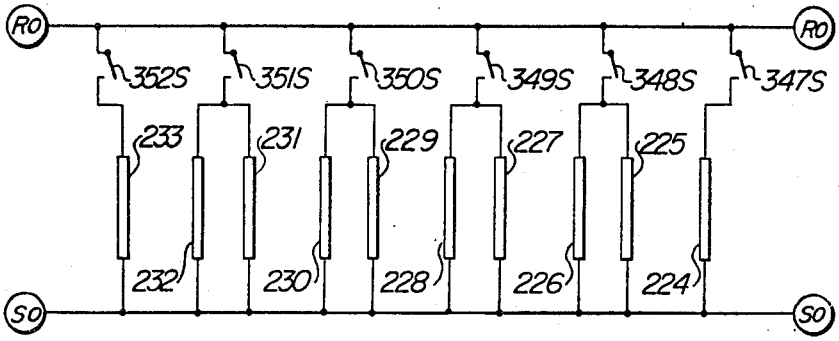
FIG. 22 is a circuit diagram of the illumination lamps.

FIG. 22 shows an illuminating circuit including the illuminating lamps 224 . . . 233 provided on the respective shiftable stack units. The illuminating lamps 224 and 233 for illuminating the aisles A and F are connected in parallel between the (+) and (−) terminals through the make contacts 347S and 352S of the illuminating lamp lighting relays 347 and 352 respectively, and the lamps for illuminating the other aisles, provided on the respective shiftable stack units, are connected in parallel between the (+) and (−) terminals through the make contacts 348S . . . 351S of the illuminating lamp lighting relays 348 . . . 351 for the respective stack units.

The operation of the embodiment of the invention constructed as described above will be explained hereunder: First of all, the normal operation of the device for forming an aisle between the desired shiftable stack units by operating the aisle switches 218 . . . 223 for the respective shiftable stack units will be explained. Although FIG. 1 shows the state wherein the aisles B and F are formed, it is assumed that the shiftable stack units 204 . . . 207 are put together on the right side of FIG. 1, and the operation will be described with reference first to the case wherein the aisle switch 219 is switched on for the formation of the aisle B as shown in FIG. 1.

The power source switch 216 is switched on at first, whereupon a single-phase A.C. voltage is impressed across the terminals RO and SO. The electromagnetic switch 277 for starting the motor is actuated and its make contact 277S is closed, whereby a three-phase A.C. voltage is applied to the terminals R1, S1 and T1. On the other hand, the voltage transformed by the transformer 275 is applied to the rectifier 273 and the D.C. voltage rectified by said rectifier appears across the (+) and (−) terminals. The power source lamp 278 is lit to illuminate the power source switch 216 portion of the control board 210, whereby the operator becomes aware of the fact that the device is connected to the power source.

In FIG. 16, the D.C. voltage appears across the (+) and (−) terminals and the safety bar switches 339 . . . 344 are all switched on, if the safety bars 237 in the respective aisles are in the normal condition. Thus, all of the safety bar operation signal receiving relays 333 . . . 338 are actuated. Therefore, the make contacts 333S . . . 338S of these relays shown in FIG. 17 are closed and the operating circuit for the safety bar operation detecting relay 313 is closed, with the result that the relay 313 is actuated. The transfer contacts **333*t* . . . 338*t* of the safety bar operation signal receiving relays 333 . . . 338 are switched to the opposite side in FIG. 18**.

In the aisle selecting circuit of FIG. 13, when the aisle switch 219 is switched on to form the aisle B, the operating circuit for the aisle selection signal receiving relay 305, extending from the (+) terminal through the aisle switch 219 and the break contact of the make-before-break contact 296S" to the (−) terminal, is closed so that the relay 305 is actuated and its make contact 305S is closed, and further a plus voltage is impressed on the terminal (a). By the plus voltage developed at the terminal (a), the operating circuit for the start instructing relay 312 in FIG. 14 is closed through the break contact 316S' and the make contact 313S, and the relay 312 is actuated. In the aisle indicating lamp circuit of FIG. 18, on the other hand, since the make contact 305S is closed, the aisle indicating lamp 359 is lighted and the aisle switch 219 portion of the control board 210 is illuminated, whereby the selection of the aisle is confirmed. In the circuits of FIGS. 15 and 19, the make contact 305S is closed, and in the circuit of FIG. 21 the make contact 305S is closed. Therefore, the operating circuit for the illuminating lamp lighting relay 348 is closed actuating the relay 348 and closing the make contact 348S in FIG. 22. Thus, the illuminating lamps 225 and 226 are lit.

In the shiftable stack unit selecting circuit of FIG. 15, the positions of the limit switches 252 . . . 261 correspond to the positions of the shiftable stack units shown in FIG. 1. In the case wherein all of the shiftable stack units are put together on the right side of FIG. 1 as stated above, the limit switch 261 only is closed and all of the remaining limit switches 252 . . . 260 are held opened. Further, in the circuit of FIG. 15, all of the short-circuit switches 320 . . . 323 are held opened; all of the aisle width control switches 265 . . . 272 are held closed; and all of the toggle switches 324 . . . 328 to switch the shiftable stack units into the stationary state are also held closed. When the break contact 305S' is opened and the make contact 312S of the start instructing relay 312 is closed by the operation of the aisle selecting signal receiving relay 305 in this state, the electromagnetic switch auxiliary relays 401, 404, 406, 408 and 410 for motors are submitted for selection. In this case, the electromagnetic auxiliary relay 401 for rightward shifting is not actuated because the limit switch 252 is open, and the electromagnetic auxiliary relays 404, 406 and 408 for leftward shifting are not actuated either because the limit switches 255, 257 and 259 and the make contacts 406S 408S and 410S of said relays connected in parallel to said limit switches, are open, but the electromagnetic switch auxiliary relay 410 for leftward shifting is actuated, with the result that the make contact 410S is closed and the break contact 410S' is opened. Therefore, the make contact 410S connected in parallel to the limit switch 259 is closed, to actuate the electromagnetic switch auxiliary relay 408 for leftward shifting. As a result, the limit switch 257 connected in parallel to the limit switch 257 is closed to actuate the electromagnetic switch auxiliary relay 406 for leftward shifting. Similarly, the electromagnetic switch auxiliary relay 404 for leftward shifting is actuated, and the electromagnetic switch auxiliary relays 410, 408, 406 and 404 for leftward shifting complete their operations sequentially. In the shift detecting circuit of FIG. 36, the make contacts 410S, 408S, 406S and 404S of these electromagnetic switch auxiliary relays are closed but the operating circuit for the shift detecting relay 303 includes only the make contacts 401S and 404S connected in parallel to the make contact 305S of the aisle selection signal receiving relay 305, which is held closed upon actuation of said relay, and is not sensitive to the other make contacts 410S, 408S and 406S. Therefore, the shift detecting relay 303 is operated by the make contact 404S.

On the other hand, in the electromagnetic switch circuit of FIG. 12 the electromagnetic switches 294, 292, 290 and 288 for leftward shifting are actuated due to closure of the make contacts 410S, 408S, 406S and 404S. In the motor circuit of FIG. 11 the three-phase A.C. voltage is impressed on the motors 241M5 . . . 241M2 from the terminals R1, S1 and T1 upon closure of the make contacts 294S, 292S, 290S and 288S, to rotate said motors in the normal direction. Therefore, the shiftable stack units 207, 206, 205 and 204 start to shift to the left. The shiftable stack unit 203 only is not shifted because the break contact 305S' is open and hence the electromagnetic switch auxiliary relay circuit for leftward shifting is not selected. Further, the circuit for rightward shifting is not operated, even if selected, because the limit switch 252 is open. The motor 241M2 on the shiftable stack unit 204 only is stopped by the aisle width control device shown in FIG. 8, at the point when the aisle width control switch 266 is actuated, because upon actuation of said switch 266, the operating circuit for the electromagnetic switch auxiliary relay 404 for leftward shifting is broken to restore the auxiliary relay 404 and also to restore the electromagnetic switch 288. Namely, the shiftable stack unit does not move up to the end of its stroke but stops at the point where the aisle width control switch 266 is actuated. As for the other shiftable stack units, the make contact 404S shown in FIG. 19 is opened incident to restoration of the electromagnetic switch auxiliary relay 404, independently of the aisle width control switch, and the shift detecting relay 303 is restored, whereby the aisle locking relay 296 to be described later is actuated to restore the aisle selection signal receiving relay 305 which has been actuated for the formation of the aisle B, and the respective shiftable stack units are brought into a halt irrespectively of the limit switches. Thus, it will be understood that when the aisle B is selected in the state wherein all shiftable stack units are put together on the right side of FIG. 1, the respective shiftable stack units are placed in the positions shown in FIG. 1 and the aisle B is formed.

In the circuit of FIG. 14, the locking delay relay 302 is actuated with a certain time delay from the point when the aisle is selected, by the effects of the resistor 314 and the capacitor 315, because upon selection of the aisle, the start instructing relay 312 is actuated and its make contact 312S is closed, and the make contact 313S is also held closed. The relay 302 closes its make contact 302S in the aisle selecting circuit of FIG. 13, but the shiftable stack units start shifting from the point when the aisle is selected, and the shift detecting relay 303 is actuated, with its break contact 303S' opened. When the shiftable stack units on both sides of the selected aisle have completed their shifting, the shift detecting relay 303 in FIG. 19 is restored and the break contact 303S' in FIG. 30 is closed. Therefore, in FIG. 13 the aisle locking relay 296 is actuated from the (+) terminal through the make contact 302S, the break contact 303S' and the make contact 305S of the aisle selection signal receiving relay 305. As a result, the make contact side of the make-before-break contact 296" is closed and the break contact side thereof is opened and self-held. At the same time, the aisle selection signal receiving relay 305 is restored which has been actuated by the aisle switch 219. By the restoration of the relay, the circuit is returned to the original state and all of the shifting stack units are brought to a halt. Further, the aisle locking relay 296 is actuated to light the aisle locking indicating lamp 369 shown in FIG. 20. In FIG. 21, the make contact 296S is closed to continuously hold the illuminating lamp lighting relay 348 in the actuated position, which has been actuated by the make contact 305S. Thus, the make contact 348S in FIG. 22 is continuously held in the operated position and the illuminating lamp is lit continuously.

In the shiftable stack unit selecting circuit of FIG. 15, the break contact 296S' of the aisle locking relay 296 is opened incident to actuation of said relay 296 and, therefore, the operating circuits for the electromagnetic auxiliary relays 401 . . . 404 for shifting the shiftable stack units 203 and 204 are not closed. Thus, the shiftable stack units 204 and 204 are held immovable no matter what instructions are given to the aisle.

When the aisle switch 221 on the control board 212 of the shiftable stack unit 205 is switched on in this state, to select the aisle D, the aisle selection signal receiving relay 307 in FIG. 13 is actuated and its make contact 307S is closed, so that the start instructing relay 312 in FIG. 31 is again actuated. On the other hand, the make contact 307S in FIG. 18 is also closed to light the aisle indicating lamp 361. The illuminating lamp lighting relay 350 in FIG. 21 is also actuated and the illuminating lamps 229 and 230 in FIG. 22 are lit.

In FIG. 15, the break contact 307S' of the aisle selection signal receiving relay 307 is opened incident to actuation of said relay, so that the circuit for rightward shifting is selected for the shiftable stack units 203, 204 and 205 and the circuit for leftward shifting is selected for the shiftable stack units 206 and 207. However, the shiftable stack units 203 and 204 will not be operated even if they are selected, because the break contact 296S' of the aisle locking relay 296 in the operating circuits for these stack units is open. The shiftable stack unit 205 will not be operated either because it is in contact with the adjacent shiftable stack unit 204, and the limit switch 256 and the make contact 403S are open. Consequently, the shiftable stack unit 207 only can actuate the electromagnetic switch auxiliary relay 410 for leftward shifting through the limit switch 261. In other words, the operating circuit extending from the (+) terminal to the (−) terminal through the make contact 312S, the conductor 318 and the break contact 309S' of the aisle selection signal receiving relay 309, and further through the limit switch 261, the aisle width control switch 272, the break contact 409S', the electromagnetic switch auxiliary relay 410 for leftward shifting, the reverse-current preventing diode 329, the break contact 284S' of the thermal relay 284, the toggle switch 328, the break contacts 300S' and 299S', the make contact 307S of the aisle selection signal receiving relay 307 actuated for the formation of the aisle D, the conductor 319 and the make contact 312S, whereby the electromagnetic switch auxiliary relay 410 is actuated. As a result, the make contact 410S of the relay 410, which is connected in parallel to the limit switch 259 in the operating circuit for the electromagnetic switch auxiliary relay 408 for the leftward shifting of the shiftable stack unit 206, is closed and said relay 408 is also actuated. In FIG. 19, the shift detecting relay 303 is actuated incident to closure of the make contact 408S of the electromagnetic switch auxiliary relay 408 for leftward shifting. In the electromagnetic switch circuit of FIG. 12, the electromagnetic switches 294 and 292 are actuated upon closure of the make contacts 410S and 408S. In the motor circuit of FIG. 11, the motors 241M5 and 241M4 are driven in the normal direction upon closure of the make contacts 294S and 292S, to shift the shiftable stack units 207 and 206 to the left. The shiftable stack units 207 and 206 continue to move until they reach the end of their leftward strokes to open the limit switch 261. When the limit switch 261 is opened, the electromagnetic switch auxiliary relay 410 for leftward shifting is restored and hence the motor 241M5 stops rotating. Since the shiftable stack units 206 and 207 are shifted while being held in contact with each other, the limit switch 259 is held open. When the electromagnetic switch auxiliary relay 410 for shifting the shiftable stack unit 207 to the left is restored, the make contact 410S connected in parallel to the limit switch 259 is opened, whereby the electromagnetic switch for leftward shifting is restored and the motor 241M4 is brought to a halt. In this case, the aisle width control switch 270 of the shiftable stack unit 206 is also actuated almost concurrently. The aisle locking relay 298 in FIG. 30 is actuated at this point. Upon actuation of the relay 298, the operating circuit for the aisle selecting signal receiving relay 307 is opened similar to the preceding case and the start instructing relay 312 in FIG. 14 is restored. Thus, the circuit is brought into the state wherein no aisles are selected. Upon actuation of the aisle locking relay 298, its make contact 298S is closed and the aisle locking indicating lamp 371 is lit. The make contact 298S in FIG. 21 is also closed, whereby the illuminating lamp lighting relay 350 is continuously held actuated, with the illuminating lamps 229 and 230 being continuously lit. On the other hand, the actuation of the aisle locking relay 298 results in opening of its break contact 298S' in FIG. 15, so that the operating circuits for the shiftable stack units 205 and 206 on both sides of the aisle D are opened and brought into a locked state.

As described above, the circuit is continuously held in the selected state from the time when the aisle is selected to the time when the shiftable stack units on both sides of the selected aisle are brought to a halt. The shiftable stack units on both sides of the aisle are automatically locked when brought to a halt, and the control circuit is restored, providing for the selection of the next aisle. However, when the shiftable stack units are arranged to form two aisles as in the present embodiment, an additional aisle cannot be formed because the embodiment is not designed to form more than two aisles concurrently.

When the aisle switch 219 is switched off upon completion of the storage work through the aisle B, the aisle A or C can be selected. For selecting the aisle C, the aisle switch 220 is switched on, whereupon the aisle selection signal receiving relay 306 in the aisle selecting circuit of FIG. 13 is actuated, similar to the preceding case, and its make contact 306S is closed. The start instruction relay 312 in FIG. 14 is actuated and the aisle indicating lamp 360 in FIG. 18 is lit. Further, the illuminating lamp lighting relay 349 in FIG. 21 is actuated to light the illuminating lamps 227 and 228 in FIG. 22. On the other hand, in FIG. 15 the break contact 306S' of the aisle selection signal receiving relay 306 is opened incident to actuation of said relay and the operating circuit for leftward shifting is selected for the shiftable stack units 207, 206 and 205 and the operating circuit for rightward shifting for the shiftable stack units 203 and 204. However, the shiftable stack units 205 and 206 are immovable because the break contact 298S' of the aisle locking relay 298 is open, and the shiftable stack unit 207 is also immovable because the limit switch 261 is open. Similarly, the shiftable stack unit 203 is immovable. Consequently, the shiftable stack unit 204 only is shifted to the right upon actuation of the electromagnetic switch auxiliary relay 403 for rightward shifting, because the limit switch 254 is closed. The shiftable stack unit 204 moves until the limit switch 254 is brought into abutment against and opened by the shiftable stack unit 203. When the limit switch 254 is opened, the aisle locking relay 297 is actuated, whereby the shiftable stack units 204 and 205 are locked in their positions and the control circuit is restored, similar to the preceding case.

The aisle switches 220 and 221 are in their ON-position at this point, so that the aisle locking relays 297 and 298 are actuated and the illuminating lamps 227, 228, 229 and 230 for the aisles C and D are lit up. When these aisle switches 220 and 221 are switched off, the aisle locking relays 297 and 298 are restored and the aisle illuminating lamps are turned off. Thereafter, two different aisles can be newly selected.

When the aisle A or F is selected at the point when all circuits are restored, all of the shiftable stack units are put together on either the right or left side and a space equivalent to two aisles is formed.

Where it is desired to form a wide aisle of a width equivalent to the width of two aisles between the selected two adjacent shiftable stack units, this can be achieved by the following operation:

Namely, if the function of the aisle width control device is released as shown in FIG. 9, the aisle can be expanded to the full length of the stretched arm. Such a wide aisle can be formed by switching the short-circuit switches 320 . . . 323 in FIG. 15 on. Namely, even when the aisle width control switches 265 . . . 272 are actuated and switched off, the electromagnetic switch auxiliary relay circuits are formed by the short-circuit switches, independently of said width control switches, and are controlled only by the limit switches 252 . . . 261.

As described above, even if the aisle B is selected in the state wherein all of the shiftable stack units are put together on the right side of the article storage device, the state of FIGS. 1 and 2 cannot be obtained but a wide aisle equivalent to two aisles is formed at the location of the aisle B, and the movement of the respective stack units is stopped by the respective limit switches.

Next, reference will be made to the case when the safety bar is actuated during the above-described normal operation.

Suppose that an obstacle is present in the aisle F when the aisle B is selected in the state wherein all of the shiftable stack units are put together on the right side of the storage device, as stated above. Upon actuating the aisle switch 219 in FIG. 30, the shiftable stack units 207, 206, 205 and 204 begin to move to the left. When the safety bar 237 projecting into the aisle F is pushed by the obstacle during the movement, either one of the safety bar switches 344 is actuated and the safety bar operation signal receiving relay 333 is restored. The make contact 338S in FIG. 17 is opened and the safety bar operation detecting relay 313 is restored. The make contact 313S in FIG. 14 is opened and the start instructing relay 312 is restored, so that the break contact 313S' in the operating circuit for the safety device operation memorizing relay 316 is closed. The relay 316 is actuated and self-held by its contact 316S. The relay 316 opens its break contact 316S' in the operating circuit for the start instructing relay 312, so that the start instructing relay 312 cannot be actuated until the safety device operation memorizing relay 316 is restored. Then, the make contact 312S in FIG. 15 is opened and the operating circuits for the electromagnetic switch auxiliary relays for motors are all opened. As a result, these electromagnetic switch auxiliary relays are all restored to restore the electromagnetic switches in FIG. 12, and thus all of the motors are stopped. On the other hand, when the safety bar 237 in the aisle F is held in the actuated position, the safety bar operational signal receiving relay 338 in FIG. 16 is held in its restored position and the safety bar operation detecting relay 313 in FIG. 17 is also held in the restored position. Therefore, the transfer contact **338*t* in FIG. 18 is switched to the position shown and the break contact 313S' in the operating circuit for the flicker relay 364 is closed to form said operating circuit. The flicker relay 364 has in its operating circuit the variable resistor 365 and the capacitor 366 connected in parallel thereto. Therefore, the flicker relay 364 is not actuated immediately after the operating circuit is closed, but is actuated with a certain time delay. When the flicker relay 364 is actuated, it opens its own break contact 364S' and is held in the actuated position for a predetermined period of time by the discharge current of the capacitor 366. Upon completion of discharge of the capacitor 366, the flicker relay 364 is again restored, whereby its break contact 364S' is closed and its operating circuit is closed. Thus, the flicker relay 364 is actuated for a predetermined period of time and restored for a predetermined period of time repeatedly, with its contact closed and opened repeatedly. The aisle indicating lamp 363 is flashed incident to the operation of the make contact 364S of the flicker relay 364, indicating that the safety device is actuated in the aisle F. On the other hand, the locking delay relay 302 in FIG. 14 is not actuated since the make contact 312S in the operating circuit thereof is open. The make contact 302S in the operating circuit for the aisle locking relay will be held opened even if the aisle selection signal receiving relay 305 in FIG. 13 is actuated, and the aisle locking relay 296 will not be actuated even if the shift detecting relay 303 in FIG. 19 is restored. Therefore, the aisle locking indicating lamps in FIG. 20 are not lit and the aisle selection signal receiving relay 305 is not restored. Thus, the aisle indicating lamp 359 in FIG. 18** is kept on.

Such a difference in the on-off state of the lamps is indicative of the difference from the case wherein the shiftable stock units are shifted and stopped in the normal condition. When the safety bar 237 is actuated only momentarily, the safety bar operation signal receiving relay is restored only momentarily and the other operation of the control circuit is the same as described above, except that the aisle indicating lamp to indicate the operation of the safety device is not flashed.

After removing the obstacle, the aisle switch 219 is switched off once and then switched on again, whereby it is possible to shift the shiftable stack units in the same manner as in the preceding case.

For the special operation, the special operation switch 217 is switched on similar to the first embodiment described previously, whereupon the special operation relay 353 in FIG. 16 is actuated and its make contact 353S is closed. Therefore, the safety bar operation detecting relay 313 is actuated even when the make contacts 333S . . . 338S in FIG. 17 are open. By reason of this relay 313, the shiftable stack units can be shifted even with the safety device in operation. The buzzer 311 intermittently sounds an alarm due to the effect of the flicker relay 364 making it known to the operator that the function of the safety device has ceased.

When the thermal relays 280 . . . 284 are actuated, the break contacts 280S' . . . 284S' thereof in FIG. 15 are opened, whereby the circuits of the electromagnetic switch auxiliary relays of the shifting stack units are opened. In this case, the shiftable stack units of which thermal relays are actuated, are stopped and the flowing shiftable stack units are also stopped as the circuits of their electromagnetic switch auxiliary relays are opened. The preceding shiftable stack unit group is also brought to a halt because the aisle locking relay for the selected aisle is actuated to restore the aisle selection signal receiving relay. Obviously, the preceding shiftable stack unit group is not necessarily composed of a plurality of stack units. When the thermal relays are actuated, the circuit can be returned to the initial state by pushing restoring relays (not shown) for said respective thermal relays.

The grounding relay 310 is actuated when a portion of the circuit is grounded to the main body, and causes the buzzer 311 to continuously sound an alarm.

The operation of the locking delay relay 302 in FIG. 14 will be further described hereunder. When the aisle switch 219, for example, is switched on in FIG. 13, the aisle selection signal receiving relay 305 is actuated, the make contact 305S on the aisle locking relay 296 is closed and the aisle is selected. There is some time delay from the point when the aisle selection signal receiving relay is actuated to the point when the electromagnetic switch auxiliary relay for motor is actuated. If the aisle locking relay 296 is actuated during this period, the aisle selection signal receiving relay 305 will be restored and the subsequent operation will not be obtained. In order to avoid this, an arrangement is made such that the locking delay relay 302 is actuated and its make contact 302S in the operating circuit for said aisle locking relay in FIG. 13 is closed with a certain time delay after the aisle is selected in FIG. 31 and the start instructing relay 312 is actuated. The break contact 303S' of the shift detecting relay 303 is opened and the aisle locking relay 296 is not actuated before the make contact 302S is closed. The time delay is so selected that the break contact 303S' is closed after the stack units on both sides of the selected aisle have been brought to a halt, and the aisle locking relay 296 is actuated at this point.

According to the embodiment of the invention described above, the stack units selected to be shifted can start to move substantially concurrently irrespective of the on or off state of their limit switches, and therefore, the time required for the formation of a desired aisle can be shortened.

Further, where it is desired to form an aisle of a width necessary for the storage operation by the aisle width control device between the selected stack units, by previously providing in a unit group of shiftable stack units a space of a width equivalent to the width of a plurality of regular aisles, the preceding stack units are all stopped at the point when the stack units on both sides of the desired aisle are stopped, and therefore, unnecessary movement of the stack units can be avoided.

Still further, since the switch means are provided to stop the motors on the respective shiftable stack units individually temporarily, the shiftable stack units can be used in two groups, for instance, the shiftable stack units 203 . . . 205 as one group and the shiftable stack units 205 . . . 207 as another group, by opening the toggle switch 326 of the shiftable stack unit 205 in the state of FIG. 1, and in this case, the shiftable stack units in the left side group will not be shifted even when the right side group of the stack units is selected. It will be understood, therefore, that if the shiftable stack units are segregated into a plurality of groups and the stack units in each group are previously arranged with a space sufficient to form an aisle, it will be possible to shift only those stack units in a selected group which are required to be shifted to form a desired aisle, without unnecessarily shifting the other stack units.

The width of the aisle can be varied within a pre-set range by arranging the aisle width control device such that it is operable stepwise to define a plurality of different aisle widths. If there be no necessity to form an aisle of a width equal to the width of a plurality of the regular aisles at a location, a flexible rod material such as a chain may be used instead of the arm of the aisle width control device, to operate the width control switch by the tension of said rod material.

Although in the embodiment described above, the storage device is provided with the limit switches which are operated when the adjacent shiftable stack units are brought into contact with or detached from each other, and the aisle width control devices by which the adjacent shiftable stack units are operatively connected with each other and the width of the aisle to be formed therebetween is controlled, such aisle width control devices are not necessarily required when the shiftable stack units are arranged with a space just enough to form one aisle.

The case when the limit switches only are provided in the second embodiment will be described hereunder with reference to the drawings of the first embodiment. In the following description, parts similar to those of the first embodiment are referred to by the same reference numerals. Namely, in the second embodiment of the invention, a shiftable stack unit the limit switch of which is placed in an ON-position, is shifted at first and the next adjacent shiftable stack unit is shifted when its limit switch is actuated by said first shiftable stack unit, and so on. Further, in the second embodiment, since there is provided a space just large enough to form one aisle, the aisles which can be formed are from A to E. In other words, the left side face of the shiftable stack unit 207 in FIG. 1 is in contact with the wall of the warehouse or the like.

Figure 7:
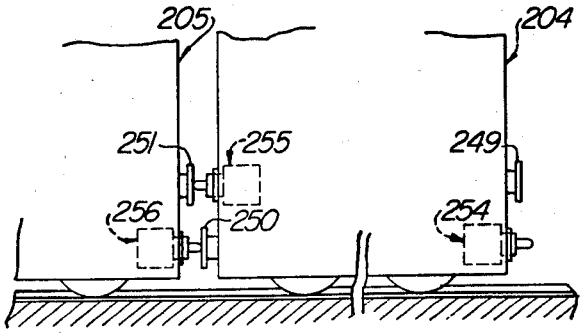
FIG. 7 is a view showing the details of the limit switch portion of the shiftable stack unit.

The shape and position of each limit switch are the same as in FIG. 7. The power source circuit of FIG. 10, the motor circuit of FIG. 11, the aisle selecting circuit of FIG. 13, the safety device operating circuit of FIG. 14, the safety bar operating circuit of FIG. 16, the safety bar operation detecting circuit of FIG. 17, the aisle lamp and warning circuit of FIG. 18, the aisle locking indicating lamp circuit of FIG. 20, the illuminating lamp lighting circuit of FIG. 21 and the illuminating lamp lighting circuit of FIG. 22 can be applied to the second embodiment as such and hence those circuits of the second embodiment are not shown. The shift detecting circuit of FIG. 19 can be used in the second embodiment by rearranging it such that the make contacts of the electromagnetic switches for rightward and leftward shifting are connected in parallel between the (+) and (−) terminals, and hence said circuit for the second embodiment is not shown.

Figure 23:
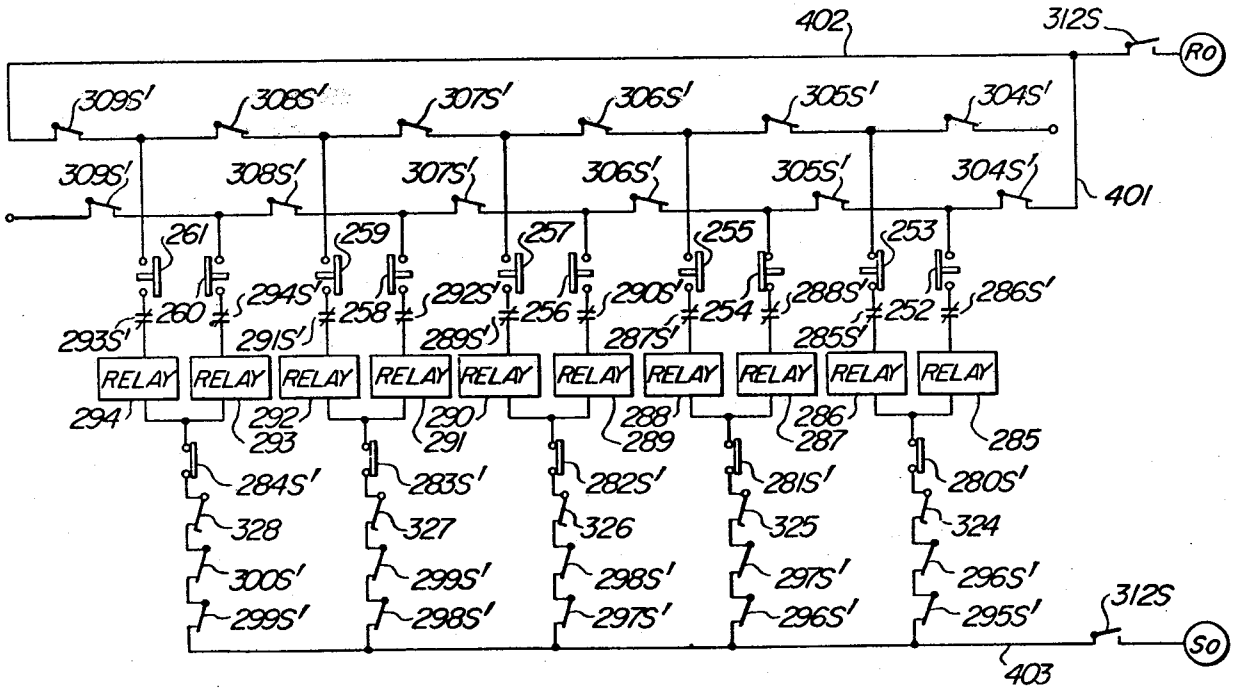
FIG. 23 is a circuit diagram of a shiftable stack selecting circuit in the third embodiment of the invention.

A shiftable stack unit selecting circuit is composed as shown in FIG. 23. As will be clear in comparison with FIG. 15 of the first embodiment, this circuit is connected between conductors 401, 402 and 403 with the same construction as that of FIG. 15, except that the aisle width control devices 265 . . . 272 and their short-circuit switches 320 . . . 323 and contacts 320C . . . 323C are removed from FIG. 15 and the electromagnetic switches 285 . . . 294 for rightward and leftward shifting and their break contacts 285S' . . . 294S' are connected in place of the electromagnetic switch auxiliary relays 401 . . . 410 for rightward and leftward shifting and their break contacts 401S' . . . 410S' respectively.

The positions of the respective limit switches in FIG. 23 are in the case when the aisle B is formed. When the aisle switch 221 is switched on to form the aisle D, the aisle selection signal receiving relay 307 is actuated and its break contact 307S' is opened, whereby the circuits for the rightward shifting of the shiftable stack units 203, 204 and 205 and the circuits for the leftward shifting or the shiftable stack units 206 and 209 are selected, as in the preceding embodiment. However, the shiftable stack unit 203 is already at the end of its rightward stroke, with its limit switch 252 opened, while the shiftable stack units 206 and 207 are already at the ends of their leftward strokes, with the limit switches 295 and 261 opened, and these stack units are not immovable. Consequently, the shiftable stack units 204 and 205 are shifted to the right. First of all, the shiftable stack unit 204 actuates the electromagnetic switch 287 for rightward shifting through the limit switch 254, whereby the motor 241M2 rotates in the reverse direction to shift the shiftable stack unit 204 to the right. The shiftable stack unit 204 continues its movement until the limit switch 254 is opened by the shiftable stack unit 203. When the limit switch 254 is opened, the electromagnetic switch 287 for rightward shifting is restored and the motor 241M2 stops its rotation. By the rightward movement of the shiftable stack unit 204, a space is formed between the shiftable stack units 204 and 205 and the limit switch 256 is restored which has been pushed by the shiftable stack unit 204. Thus, the operating circuit for the electromagnetic switch 289 for rightward shifting is closed and the shiftable stack unit 205 starts to move with a certain time delay from the start of the shiftable stack unit 204. The limit switch 256 is opened by being pushed by the shiftable stack unit 204 to open the operating circuit for the electromagnetic switch 289 for rightward shifting, whereby the rightward shifting of the shiftable stack unit 205 is stopped.

The aisle locking relay 298 in FIG. 13 is actuated at the point when the shiftable stack unit 205 is brought to a halt, so that the operating circuit for the aisle selection signal receiving relay 307 is opened and the start instructing relay 312 in FIG. 14 is restored. In this state, no aisle is selected.

In the second embodiment as well as in the first embodiment, when the aisle has been formed, the shiftable stack unit on both sides of said aisle only are locked and the other shiftable stack units remain in the shiftable state. Therefore, if a space is previously provided which is just sufficient to form two aisles, and the shiftable stack units are segregated into two groups on the right and left sides of the stack unit 205, an aisle can be formed within each group independently of the other group. Namely, all of the shiftable stack units are put together on the right side at first and then the aisle switch of the shiftable stack unit 204 is actuated to form an aisle between the shiftable stack units 204 and 205. Upon formation of the aisle, the aisle switch of the shiftable stack unit 205 is actuated, whereby said shiftable stack unit 205 is brought to a halt. Then, the toggle switch to lock the shiftable stack unit 205 is switched off, whereby said shiftable stack unit 205 can temporarily be used as a stationary stack unit and all of the shiftable stack units can be used in two groups, one consisting of the shiftable stack units 203 and 204 and the right half of the shiftable stack unit 205 and another group consisting of the left half ot the shiftable stack unit 205 and the shiftable stack units 206 and 207.

It is, of course, possible to use the shiftable stack units by segregating them into three or more groups, by previously providing a space enough to form two or more aisles.

The aisle width control devices of the first embodiment may be incorporated in the third embodiment described above. In this case, the aisle width control switches and their short-circuit switches of the device are connected between the respective limit switches and the break contacts of the respective electromagnetic switches shown in FIG. 23, whereby the shiftable stack units are stopped automatically when the aisle being formed therebetween has reached a predetermined width.

What is claimed is:

1. A shiftable article storage device comprising a plurality of article storage units each movably arranged on a floor and disposed to be put together with no space left between adjacent storage units when access to them is not desired, while a selected one of them is shifted to create an aisle between itself and the adjacent storage unit when access to said selected one or ones of said storage units is desired; wherein each of said article storage units is provided with a motor to shift it in two directions toward the adjacent article storage units and control means to control the amount of movement of said storage units so that at least two desired aisles may be automatically formed at different locations between said storage units.

2. A shiftable article storage device according to claim 1, which further comprises an aisle selecting circuit for forming the aisle between said specific article storage unit and said adjacent article storage unit to provide access to said specific article storage unit, and an article storage unit selecting circuit for shifting a plurality of said article storage units in cooperation with said control means in response to a signal from said aisle selecting circuit.

3. A shiftable article storage device according to claim 2, which further comprises detecting means for detecting an obstacle in an aisle which is being closed to provide the formation of a new aisle, and a stopping circuit for stopping the motors in motion upon actuation of said detecting means.

4. A shiftable article storage device according to claim 3, wherein said aisle selecting circuit comprises a screening element provided at the input terminal thereof and opened automatically to prohibit the dispatch of the next aisle instruction when said circuit is set in operation for the formation of one aisle, and a manually operable switch connected in parallel to said screening element, whereby a plurality of aisles are formed.

5. A shiftable article storage device according to claim 2, wherein said aisle selecting circuit comprises a screening element provided at the input terminal thereof and opened automatically to prohibit the dispatch of the next aisle instruction when said circuit is set in operation for the formation of one aisle, and a manually operable switch connected in parallel to said screening element, whereby a plurality of aisles are formed.

6. A shiftable article storage device according to claim 1, wherein said control means is so designed that it is held in an OFF-position when the associated article storage unit is in contact with the adjacent one and in an ON-position when the associated article storage unit is spaced from the adjacent one to form an aisle therebetween, thereby to detect whether the two article storage units are in contact or not.

7. A shiftable article storage device according to claim 1, wherein said control means includes aisle width control means by which adjacent ones of said article storage units are operatively connected with each other and the width of the aisle formed upon shifting of said article storage units is controlled.

8. A shiftable article storage device according to claim 1 which further comprises detecting means for detecting an obstacle in an aisle which is being closed to provide the formation of a new aisle, and a stopping circuit for stopping the motors in motion upon actuation of said detecting means.

9. A shiftable article storage device comprising a plurality of article storage units each movably arranged on a floor and disposed to be put together with no space left between adjacent storage units when access to them is not desired, while a selected one of them is shifted to create an aisle between itself and the adjacent storage unit when access to said selected one or ones of said storage units is desired; wherein each of said article storage units is provided with a motor to shift it in two directions toward the adjacent article storage units, detecting means for detecting whether adjacent ones of said article storage units are in contact with each other or not, and there are provided an aisle selecting circuit for forming the aisle between said specific article storage unit and the adjacent article storage unit to provide for access to said specific article storage unit, and an article storage unit selecting circuit for controlling the rotation of said motor on each of said selected article storage units in response to the aisle instructing signal from said aisle selecting circuit to shift said article storage units in the same direction independently of said detecting means, said storage unit selecting circuit having control means to control the amount of movement of each of the shifted storage units to form at least two aisles.

10. A shiftable article storage device according to claim 9 wherein said control means includes aisle width control means by which adjacent ones of said article storage units are operatively connected with each other and the width of an aisle formed therebetween is controlled, and which further includes a control circuit for stopping concurrently the motors on the article storage units which have been selected to shift in the same direction by the function of said aisle width control means.

11. A shiftable article storage device according to claim 10, wherein said article storage unit selecting circuit further comprises switch means for individually temporarily stopping the rotation of the motor on each article storage unit, whereby all of the article storage units are segregated into groups by the article storage units which have been brought to a halt upon opening of said switch means and are held stationary, and a control circuit for shifting the article storage units in each group without shifting those in the other groups.

12. A shiftable article storage device according to claim 10, which further comprises detecting means for detecting an obstacle in an aisle which is being closed to provide for the formation of a new aisle, and a stopping circuit for stopping the rotation of the motors in motion upon actuation of said detecting means.

13. A shiftable article storage device according to claim 9, wherein said article storage unit selecting circuit further comprises switch means for individually temporarily stopping the rotation of the motor on each article storage unit, whereby all of the article storage units are segregated into groups by the article storage units which have been brought to a halt upon opening of said switch means and are held stationary, and a control circuit for shifting the article storage units in each group without shifting those in the other groups.

* * * * *

UNITED STATES PATENT AND TRADEMARK OFFICE

CERTIFICATE OF CORRECTION

PATENT NO. : 4,412,772

DATED : November 1, 1983

INVENTOR(S) : Han-Ichiro Naito et al

It is certified that error appears in the above—identified patent and that said Letters Patent is hereby corrected as shown below:

Abstract , line 8, between "of" and "one" read --the--.

Column 3, line 37, for "an" (first occurrence) read --and--.

Column 6, line 43, for "looking" read --locking--.

Column 6, line 55, between "operated" and "shifting" read --during--.

Column 8, line 26, before the comma and "contact" read --a--

Column 8, line 39, for "328" read --323--

Column 8, line 50, for "facting" read --facing--

Column 9, line 36, for "304S'" read --364S'--

Column 9, line 37, for "305" read --365--

Column 9, line 42, for "capable" read --capacitor--

Column 10, line 23, for "te" read --the--

Column 11, line 63, between "406S" and "408S" read a comma

Column 12, line 3, for "limit switch 257" read --make contact 408S--

Column 13, line 34, for "204" (first occurrence) read --203--

UNITED STATES PATENT AND TRADEMARK OFFICE

CERTIFICATE OF CORRECTION

PATENT NO. : 4,412,772 Page 2 of 2

DATED : November 1, 1983

INVENTOR(S) : Han-Ichiro Naito et al

It is certified that error appears in the above-identified patent and that said Letters Patent is hereby corrected as shown below:

Column 17, line 28, for "flowing" read --following--

Column 19, line 39, for "or" read --of--

Column 20, line 29, for "ot" read --of--

Column 21, line 8, (claim 4, line 2) for "3" read --2--

Column 21, line 17 (claim 5, line 2) for "2" read --3--

Column 22, line 28 (claim 11, line 2) for "10" read --9--

Column 22, line 44 (claim 13, line 2) for "9" read --10--

Signed and Sealed this

Seventh Day of February 1984

[SEAL]

*Attest:*

GERALD J. MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,412,772

DATED : November 1, 1983

INVENTOR(S) : Han-Ichiro Naito, et al

It is certified that error appears in the above-identified patent and that said Letters Patent is hereby corrected as shown below:

Column 2, line 17, delete "each".

Column 4, line 20, change "shows" to -- show -- .

Column 6, line 25, before "make" insert --set of--.

Column 7, line 10, change "short-circuiting" to -- short-circuit--.

Column 7, line 26, change "404" to --404S--.

Column 11, line 47, change "opened" to --open--.

Column 17, line 51, after "for", insert --a--.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*